US008777318B2

(12) United States Patent
Chen

(10) Patent No.: US 8,777,318 B2
(45) Date of Patent: Jul. 15, 2014

(54) HEIGHT ADJUSTMENT MECHANISM FOR ARMREST

(71) Applicant: Atec International Team Co., Ltd., Luzhu Township, Taoyuan County (TW)

(72) Inventor: Te-Chun Chen, Taoyuan (TW)

(73) Assignee: Atec International Team Co., Ltd., Luzhu Township, Taoyuan County (TW)

( * ) Notice: Subject to any disclaimer, the term of this patent is extended or adjusted under 35 U.S.C. 154(b) by 47 days.

(21) Appl. No.: 13/754,206

(22) Filed: Jan. 30, 2013

(65) Prior Publication Data

US 2013/0320739 A1 Dec. 5, 2013

(30) Foreign Application Priority Data

Jun. 1, 2012 (TW) ..... 101119831 A

(51) Int. Cl.
*A47C 7/54* (2006.01)
*A47C 1/03* (2006.01)

(52) U.S. Cl.
CPC .... *A47C 7/54* (2013.01); *A47C 1/03* (2013.01)
USPC ..... 297/411.36

(58) Field of Classification Search
USPC ..... 297/411.36
See application file for complete search history.

(56) References Cited

U.S. PATENT DOCUMENTS 5,388,892 A 2/1995 Tornero
5,620,233 A 4/1997 Corwin
6,053,579 A 4/2000 Nelson et al.
6,336,680 B1 1/2002 Lee
6,398,309 B1 * 6/2002 Chen ..... 297/411.36
6,419,323 B1 7/2002 Chu et al.
6,619,746 B2 * 9/2003 Roslund et al. ..... 297/411.36
6,837,545 B1 * 1/2005 Ho ..... 297/411.36
6,974,189 B2 12/2005 Machael et al.
6,974,190 B1 12/2005 Hung
6,976,739 B2 * 12/2005 Wang ..... 297/411.36 X
7,246,859 B2 * 7/2007 Igarashi et al. ..... 297/411.36
7,533,939 B2 * 5/2009 Fookes et al. ..... 297/411.36
7,556,316 B1 * 7/2009 Lai ..... 297/411.36
7,770,979 B2 * 8/2010 He ..... 297/411.36
7,815,259 B2 * 10/2010 Fookes et al. ..... 297/411.36 X
7,828,389 B2 * 11/2010 Oda ..... 297/411.36
7,980,632 B2 * 7/2011 Pai ..... 297/411.36
8,128,171 B2 * 3/2012 Tsai ..... 297/411.36
8,128,172 B2 * 3/2012 Tsai ..... 297/411.36
2007/0164595 A1 7/2007 Chi
2008/0036264 A1 * 2/2008 Pan ..... 297/411.36
2008/0036265 A1 * 2/2008 Pan ..... 297/411.36
2008/0191537 A1 8/2008 Oda
2008/0296955 A1 12/2008 Geister et al.

* cited by examiner

*Primary Examiner* — Rodney B White
(74) *Attorney, Agent, or Firm* — Muncy, Geissler, Olds & Lowe, P.C.

(57) ABSTRACT

A height adjustment mechanism for armrests is revealed. The height adjustment mechanism includes a tubular base disposed with positioning holes, an outer sleeve disposed around the tubular base and having an opening arranged at a top end thereof, a strip rack mounted in the outer sleeve and disposed with an insertion slot on a lower part thereof, a pull handle mounted in the strip rack, a positioning member arranged at a lower end of the pull handle and inserted through the insertion slot of the strip rack to be locked in the positioning hole of the tubular base, a press member passed through the opening of the outer sleeve to be connected to a top end of the pull handle, and an alignment member disposed on corresponding surfaces of the strip rack and the pull handle for limiting vertical displacement of the pull handle and the strip rack.

10 Claims, 6 Drawing Sheets

HEIGHT ADJUSTMENT MECHANISM FOR ARMREST

BACKGROUND OF THE INVENTION

The present invention relates to a height adjustment mechanism for armrests, especially to a height adjustment mechanism for armrests suitable for thin wall structure, and more convenient in assembly and mold production.

Most of armrest available now have various types of adjustment mechanism such as a height adjustment mechanism for armrests used to adjust height of the armrest according to sitter's figure or needs and make users feel more comfortable. There are a plurality of prior arts related to the height adjustment mechanism for armrests such as U.S. Pat. Nos. 5,388,892, 5,620,233, 6,053,579, 6,336,680, 6,419,323, 6,974,189, 6,974,190, US2007/0164595, US2008/0191537, US2008/0296955, etc. However, devices revealed in these patents all have their disadvantages such as more components required and complicated structure, use of many screws for fastening, difficulty in assembly, labor-intensive and time-consuming assembly, high manufacturing cost, use of more molds, difficulty in mold production, more material consumption without improvement in structural strength, difficult adjustment and operation, insufficient stability during adjustment, etc. Thus there is room for improvement and a need to provide a novel height adjustment mechanism for armrests. The novel height adjustment mechanism for armrests is with improved design in the space form, the number of the components and difficulty levels in assembly and adjustment so as to increase the effects of the armrest, reduce manufacturing cost and improve the competitiveness.

SUMMARY OF THE INVENTION

Therefore it is a primary object of the present invention to provide a height adjustment mechanism for armrests in which an alignment member produced by an injection molding mold is disposed between a strip rack and a pull handle of a height adjustment mechanism. Thus the strip rack and the pull handle are easily assembled and the alignment member is used to limit the vertical displacement. Therefore the assembling and the mold production are more convenient. The manufacturing cost is also reduced.

It is another object of the present invention to provide a height adjustment mechanism for armrests in which two slots are formed on the injection molding mold so that two rear ends of a C-shaped ring used for preventing swinging are mounted and located in the two slots. Thereby the mold production is more convenient and the manufacturing cost is also reduced.

It is a further object of the present invention to provide a height adjustment mechanism for armrests that includes a positioning member disposed with an inclined projection. While being assembled, the projection is moved and automatically locked in one of the positioning holes most close to the top, without falling off. Thus the convenience of assembly is increased.

It is a further object of the present invention to provide a height adjustment mechanism for armrests in which locking parts arranged at the press member are respectively lock on edges of an opening of an outer sleeve for improving connection and positioning of the press member. Such design can also avoid disadvantages of conventional press member connected by male-female mounting such as easy breakage.

DETAILED DESCRIPTION OF THE PREFERRED EMBODIMENT

Figure 1:
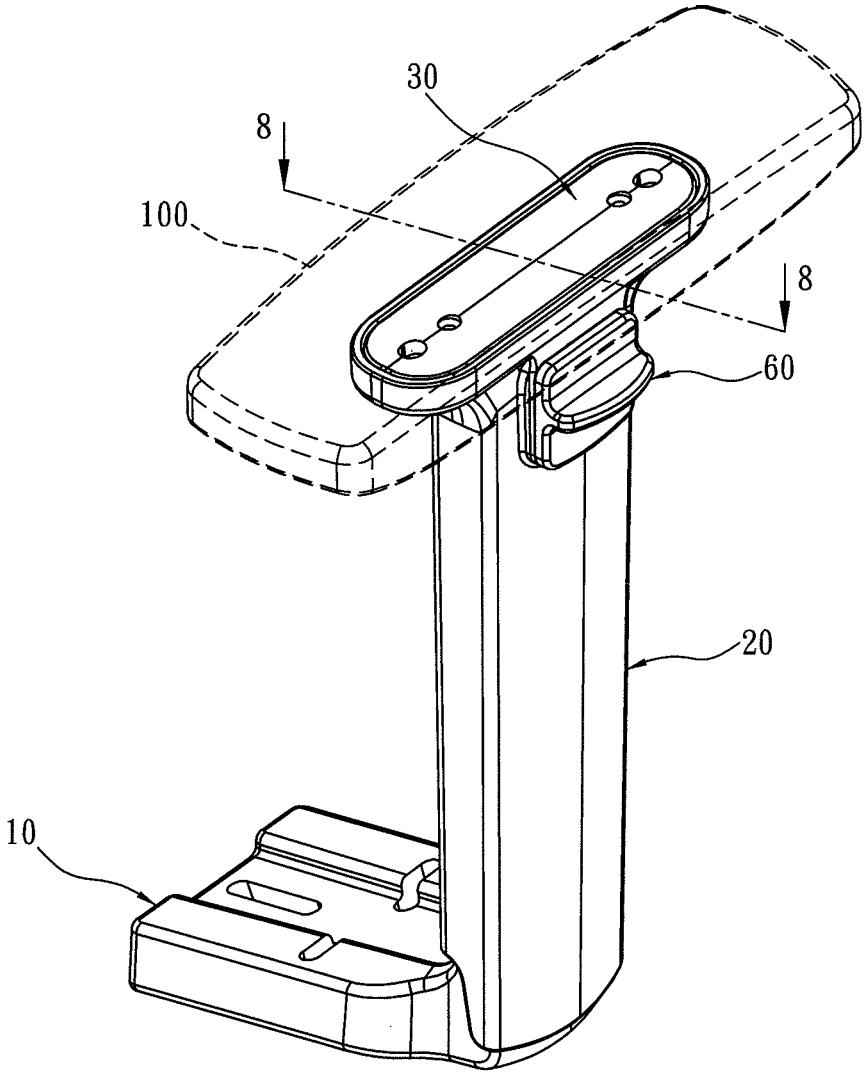
FIG. 1 is a perspective view of an embodiment of a height adjustment mechanism for armrests according to the present invention.
Figure 2:
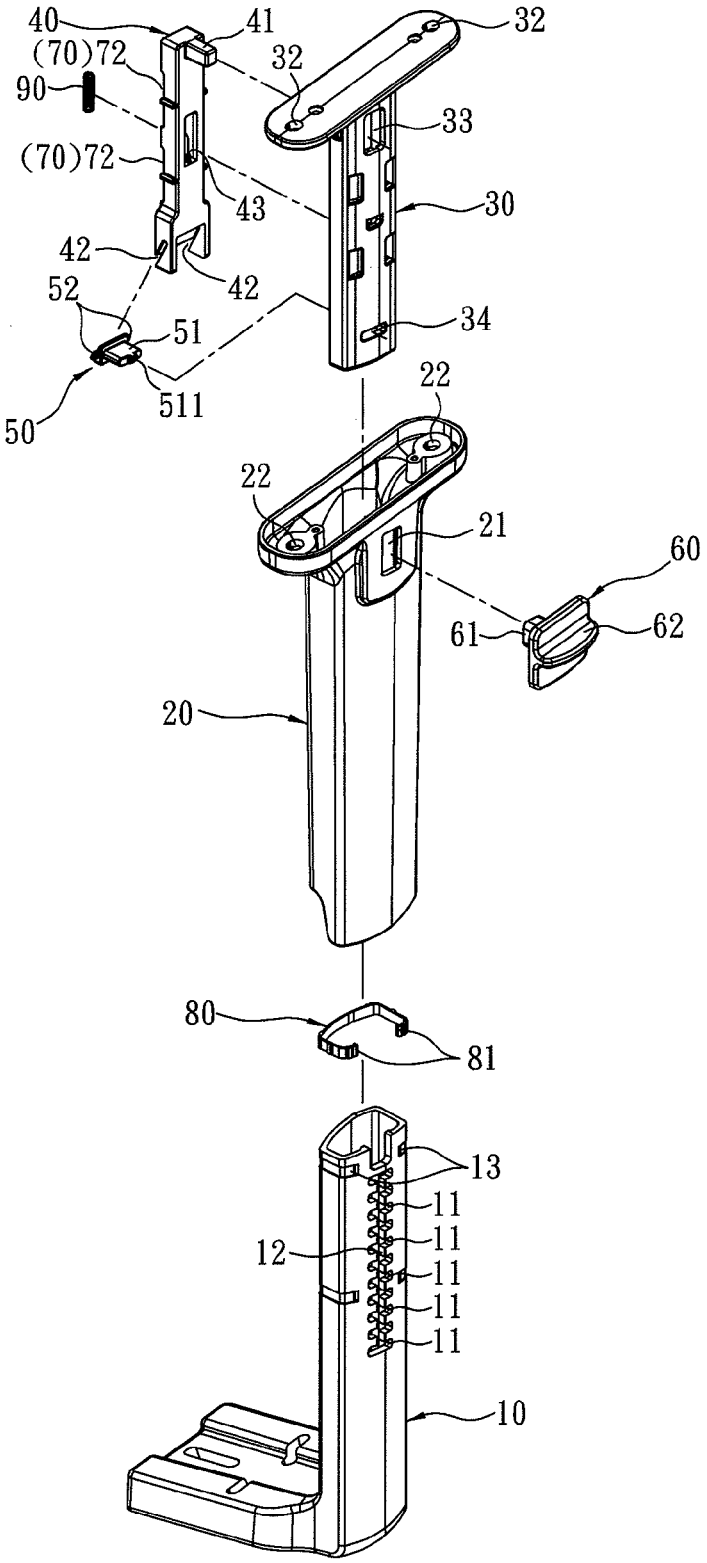
FIG. 2 is an explosive view of the embodiment in FIG. 1.
Figure 3:
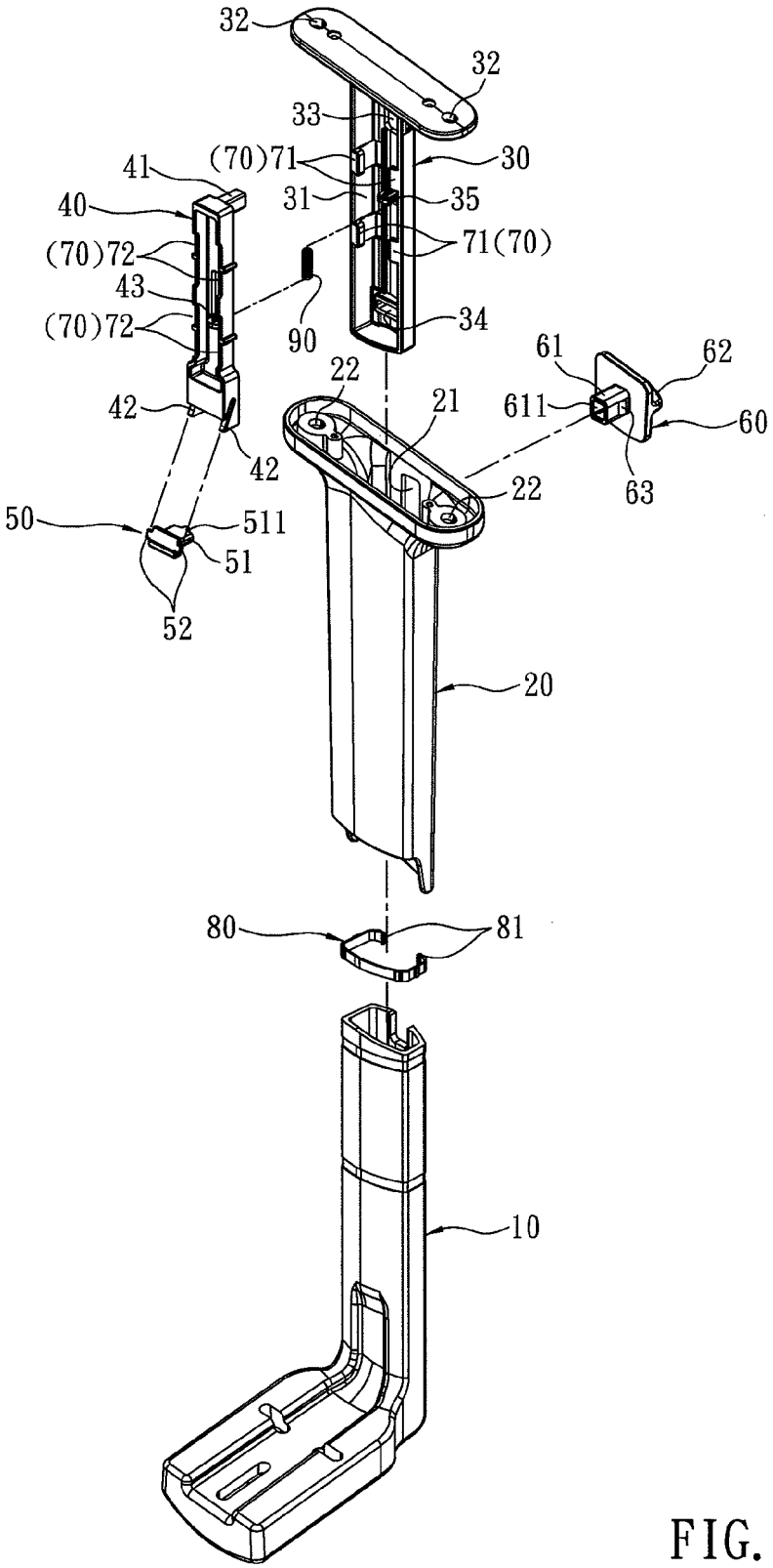
FIG. 3 is another explosive view of the embodiment in FIG. 2 viewed from another angle.

Refer to FIG. 1, FIG. 2 and FIG. 3, a height adjustment mechanism for armrests of the present invention includes a tubular base 10, an outer sleeve 20, a strip rack 30, a pull handle 40, a positioning member 50, a press member 60 and an alignment member 70.

A lower part of the tubular base 10 is connected to a chair seat while an upper part thereof is disposed with a plurality positioning holes 11 arranged vertically with a certain interval. The positioning holes 11 are connected by a vertical long slot 12. The shape of the tubular base 10 can be, but not limited to, L-shaped or I-shaped (not shown in figures).

The outer sleeve 20 is disposed around the tubular base 10. An opening 21 is disposed on a top end of the outer sleeve 20 while an armrest pad 100 for users to rest their arms is arranged at a top surface of the outer sleeve 20. A threaded hole 22 is set on a front end as well as a rear end (from the user's point of view) of the top surface of the outer sleeve 20. A locking screw is passed through the threaded hole 22 to be threaded with the strip rack 30 and the armrest pad 100. The outer sleeve 20 is one piece made from plastic by thin-wall injection molding. Thus the manufacturing processes are simplified, the total weight is reduced, the cost is down and the convenience in assembly is improved.

The strip rack 30 is a T-shaped strip rack 30 mounted in the outer sleeve 20 and located inside the tubular base 10. A groove 31 is formed along the length direction of the strip rack 30 and a through hole 32 corresponding to the threaded hole 22 of the outer sleeve 20 is disposed on top of the strip rack 30. By a locking screw passing through the through hole 32 and the threaded hole 22, the strip rack 30, the outer sleeve 20 and the armrest pad 100 are fastened and connected with one another. An upper part of the strip rack 30 is mounted with an opening 33 corresponding to the opening 21 of the outer sleeve 20 while an insertion slot 34 corresponding to one of the positioning holes 11 of the tubular base 10 is disposed on a lower part of the strip rack 30. An outer edge of the insertion slot 34 is projecting to form an edge with a certain thickness so that the insertion slot 34 has a certain depth. That means the thickness of the strip rack 30 is increased to improve structure strength.

The pull handle 40 is mounted in the groove 31 of the strip rack 30. A projective rod 41 is disposed on a top end of the pull handle 40 while a guiding slot 42 is arranged at each of two opposite sides on a bottom end of the pull handle 40. The projective rod 41 is inserted through the opening 33 of the strip rack 30 and the opening 21 of the outer sleeve 20 and is movable vertically within the opening 33 and the opening 21. The guiding slot 42 is inclined and extended downward and outward.

Figure 6:
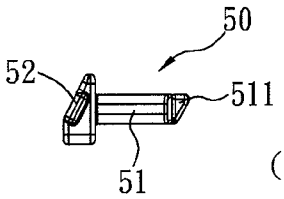
FIG. 6 is a side view of a positioning member of an embodiment of a height adjustment mechanism for armrests according to the present invention.

The positioning member 50 includes a locking part 51 arranged at one end while a left side and a right side of the other end thereof project to form a guiding block 52 respectively. The locking part 51 is inserted through the insertion slot 34 of the strip rack 30 to be locked in one of the positioning holes 11 of the tubular base 10. Each of the two guiding blocks 52 is limited in and moved along the guiding slot 42 of the pull handle 40. By the oblique alignment between the inclined guiding slots 42 of the pull handle 40 and the guiding blocks 52 of the positioning member 50, a vertical movement of the pull handle 40 is converted into a horizontal movement of the positioning member 50 to allow the locking part 51 of the positioning member 50 being released from one of the positioning holes 11 of the tubular base 10. As shown in FIG. 2, FIG. 3 and FIG. 6, one end of the locking part 51 is designed into an inclined projection 511 that is moved along the long slot 12 of the tubular base 10. While being assembled, the projection 511 is moved along the long slot 12 of the tubular base 10 to be locked in the positioning hole 11 most close to the top, without falling off. Thus the convenience in assembling is increased and the positioning member 50 will not fall off easily during the assembling due to that the locking part 51 has not being inserted into the positioning hole 11 of the tubular base 10.

Figure 7:
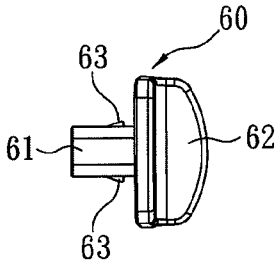
FIG. 7 is a top view of a press member of an embodiment of a height adjustment mechanism for armrests according to the present invention.
Figure 5:
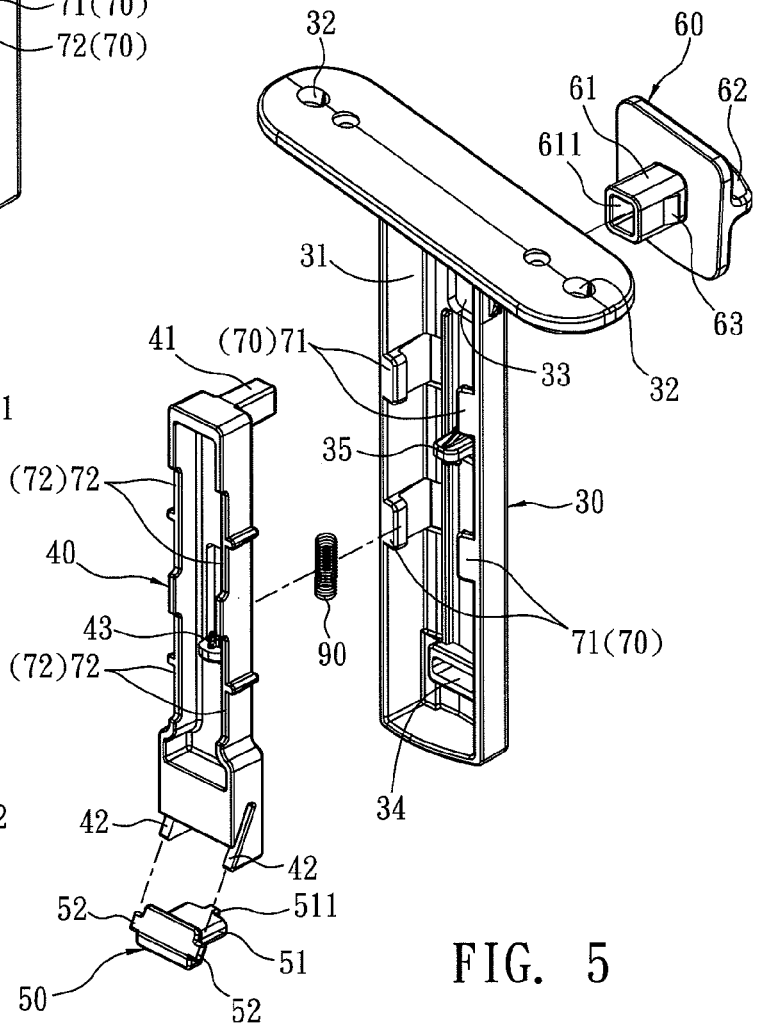
FIG. 5 is an explosive view of the embodiment in FIG. 4.

The press member 60 is passed through the opening 21 of the outer sleeve 20 to be connected to the top end of the pull handle 40. A projecting body 61 with a concave hole 611 is arranged at one end of the press member 60 while an operation part 62 is disposed on the other end thereof. The concave hole 611 of the projecting body 61 is disposed around the projective rod 41 of the pull handle 40 while the operation part 62 is exposed outside the opening 21 of the outer sleeve 20, allowing users to move the press member 60 vertically and drive the pull handle 40 to act synchronously. The left side and the right side of the projecting body 61 of the press member 60 respectively project to form a locking part 63, as shown in FIG. 3, FIG. 5 and FIG. 7. The locking parts 63 are locked on the left edge and the right edge of the opening 21 of the outer sleeve 21 for improving connection and positioning of the press member 60. Such design can avoid shortcomings of conventional press member that is connected by male-female mounting such as easy breakage.

Figure 4:
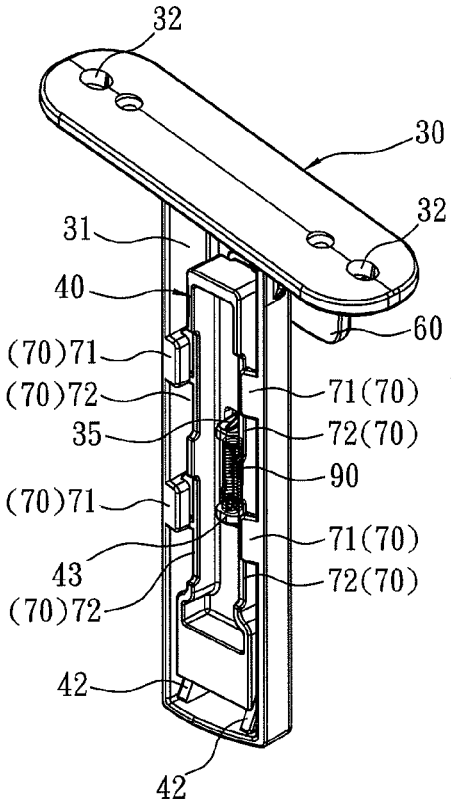
FIG. 4 is an assembled perspective view of a strip rack, a pull handle, a positioning member, and a press member of an embodiment of a height adjustment mechanism for armrests according to the present invention.

The alignment member 70 includes at least a pair of projecting blocks 71 and at least a pair of slots 72 corresponding to each other and respectively disposed on corresponding surfaces of the strip rack 30 and the pull handle 40. The projecting blocks 71 and the slots 72 are corresponding to each other and the projecting block 71 is able to move along the long slot 72 so as to limit the displacement of the pull handle 40 in relation to the strip rack 30 when the press member 60 is operated by users. Moreover, during the assembling process, the alignment member 70 provides an alignment function so that the pull handle 40 and the strip rack 30 can be assembled conveniently. As shown in FIG. 3, FIG. 4 and FIG. 5, the left and right sides of the strip rack 30 project so as to form the pair of the projecting blocks 71 while the left and right sides of the pull handle 40 are concaved to form the pair of the long slots 72. The projecting blocks 71 can be integrated with the strip rack 30 and produced by an injection molding mold of the strip rack 30. The long slots 72 are also manufactured together with the pull handle 40 by a mold. Thus the number of molds required for the manufacturing processes is decreased.

Refer to FIG. 2, the outer edge of the opening 21 of the outer sleeve 20 is projecting to form the edge with a certain thickness and allow the opening 21 to have a certain depth. That means the thickness of the outer sleeve 20 is increased and the structural strength is enhanced. Thus the locking part 63 of the press member 60 is firmly connected to and fastened with the opening 21 of the outer sleeve due to the edge of the opening 21. The connection and the positioning effects are both improved and the shortcomings of conventional press member connected by male-female mounting such as easy breakage can be avoided.

Refer to FIG. 2 and FIG. 3, the height adjustment mechanism for armrests of the present invention further includes at least one C-shaped ring 80. The C-shaped ring 80 is disposed between the tubular base 10 and the outer sleeve 20 and is arranged around an upper part of the tubular base 10 for providing a stable leaning effect therebetween. Thus the outer sleeve 20 will not weave while the outer sleeve 20 is moved vertically in relation to the tubular base 10 and the stability is enhanced. In this embodiment, two slots 13 corresponding to two rear ends 81 of the C-shaped ring 80 are disposed on an upper part of the tubular base 10. Thus the two rear ends 81 of the C-shaped ring 80 are mounted and located in the two slots 13 respectively. The two slots 13 can be formed directly on side surfaces 11 of the tubular base 10 by the design of the injection mold so as to simplify manufacturing processes and reduce manufacturing cost.

Refer from FIG. 2 to FIG. 5 and from FIG. 8 to FIG. 11, a height adjustment mechanism for armrests further includes an elastic member 90. The elastic member 90 can be, but not limited to, a compression spring such as spring clip. The elastic member 90 is arranged between the strip rack 30 and the pull handle 40. The strip rack 30 and the pull handle 40 are respectively disposed with a stopper 35 and a stopper 43, both corresponding to the elastic member 90. One end of the elastic member 90 is elastically leaning against the stopper 35 of the strip rack 30 while the other end of the elastic member 90 is elastically leaning against the stopper 35 of the pull handle 40. The elasticity of the elastic member 90 is used as a driving force to turn the pull handle 40 back to the original position. When the press member 60 is operated to move the pull handle 40 upward, the elastic member 90 is compressed. When the pull handle 40 is released, the pull handle 40 is driven by an elastic recovery force of the elastic member 90 to move downward and back to the original position.

While in use, the user grasps the outer sleeve 20 or the armrest pad with his hands and operates the press member 60 to move upward for driving the pull handle 40 to move upward. By the inclined alignment between the pull handle 40 and the positioning member 50, the positioning member 50 is moved inward and horizontally and the locking part 51 of the positioning member 50 is released from one positioning hole 11 of the tubular base 10. Thus the outer sleeve 20 and the strip rack 30 can move vertically in relation to the tubular base 10 for height adjustment. Then the press member 60 is released to turn the pull handle 40 back to the original position. Next the positioning member 50 is moved in opposite direction (outward and horizontally) to be locked into another positioning hole 11 of the tubular base 10. Thus the armrest height adjustment is completed. When the pull handle 40 is moved vertically in relation to the strip rack 30 for height adjustment of the armrest, the displacement of the pull handle 40 in relation to the strip rack 30 is limited by the projecting blocks 71 of the alignment member 70 being moved along and in relation to the long slots 72.

When the user's hand is leaning against the armrest of the chair, there is a force pressing downward. The present invention receives the force stably by the insertion slot 34 with the increased depth. The increased depth of the insertion slot 34 not only increases the structural strength of the device but also improves the stability of the locking part 51 of the positioning member 50 while the locking part 51 being moved in the insertion slot 34.

Figure 8:
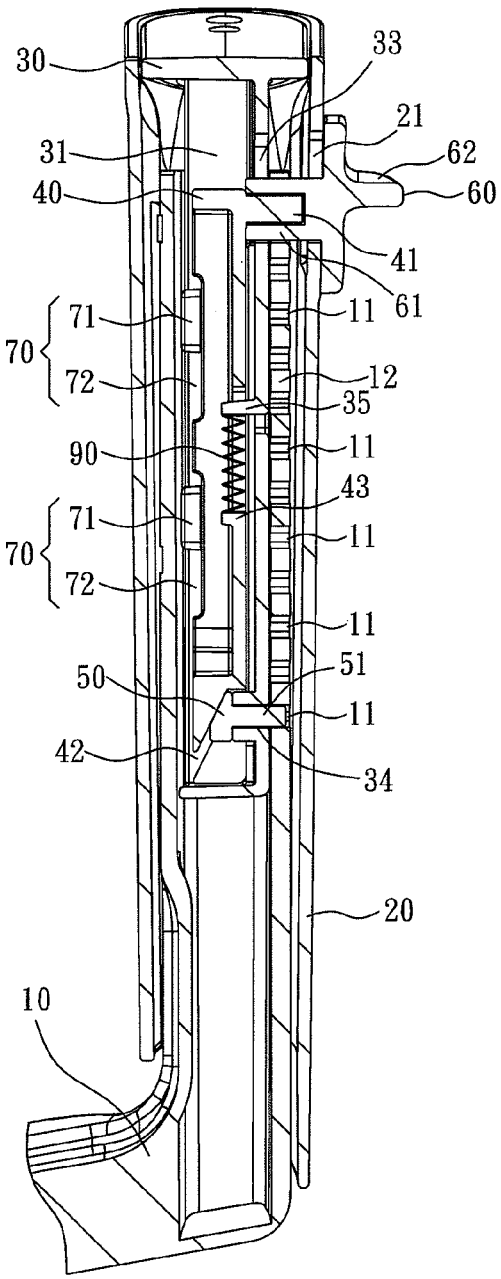
FIG. 8 is a cross sectional view of the embodiment in FIG. 1 along the 8-8 line for showing status before height adjustment.

Refer to FIG. 8, before the pull handle 40 being moved upward, the positioning member 50 in the guiding slot 42 of the pull handle 40 is at a higher position while the locking part 51 of the positioning member 50 is locked in one positioning holes 11 of the tubular base 10. At this moment, the projecting blocks 71 of the alignment member 70 are in a higher position of the slots 72.

Figure 9:
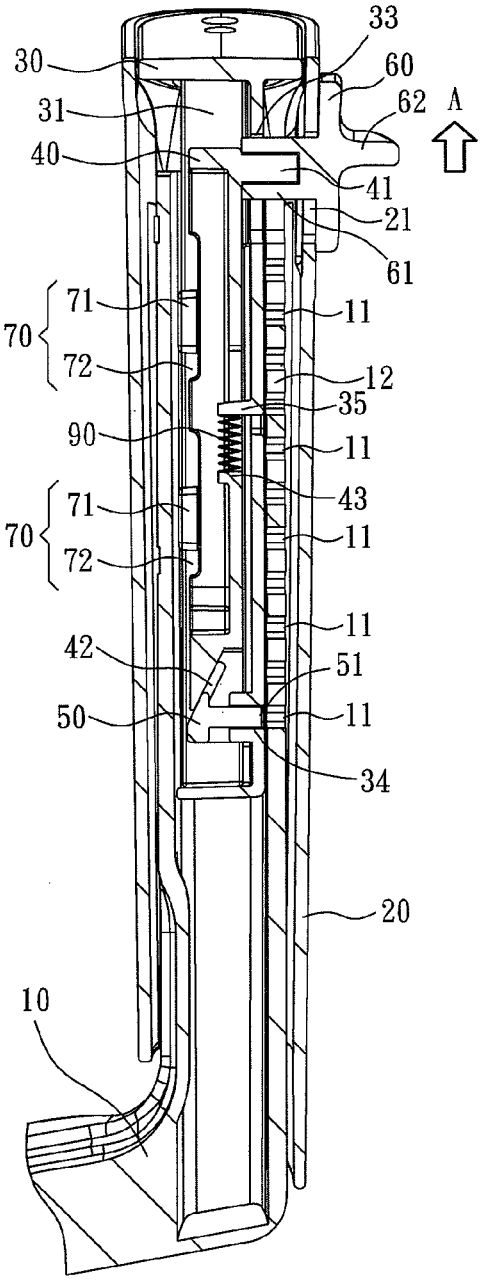
FIG. 9 and FIG. 10 are cross sectional views of the embodiment in FIG. 1 showing status during height adjustment.
Figure 10:
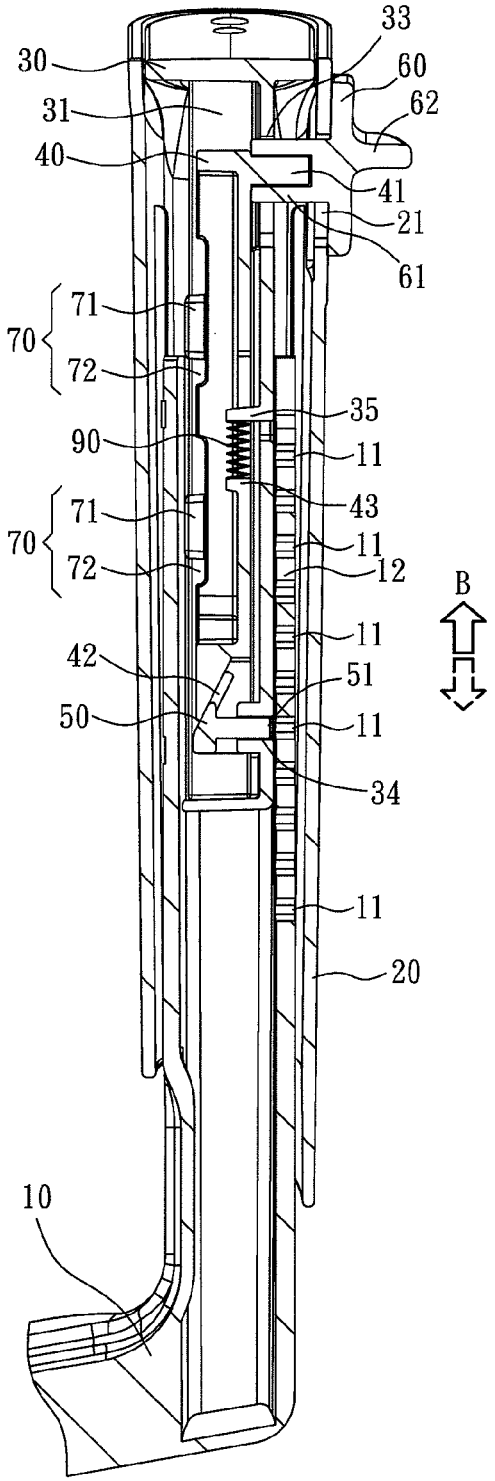

Refer to FIG. 9 and FIG. 10, for adjusting height of the armrest, first operate the press member 60 to move upward and drive the pull handle 40. As the arrow A indicates in FIG. 9, the pull handle 40 is driven to move upward and the elastic member 90 is in a compressed state. The projecting blocks 71 of the alignment member 70 are moved along the slots 72 from the higher position to a lower position. At the same time, by the inclined alignment between the inclined guiding slots 42 of the pull handle 40 and the guiding blocks 52 of the positioning member 50, the vertical movement of the pull handle 40 is converted into the horizontal movement of the positioning member 50 so that the positioning member 50 is moved along the guiding slot 42 from the higher positioning to a lower position. Thus the locking part 51 of the positioning member 50 is moved inward (toward the left side in the figure) to be released from the positioning hole 11 of the tubular base 10 and the positioning member 50 is moved upward and downward freely (as the arrow B indicates in FIG. 10) for height adjustment of the armrest.

Figure 11:
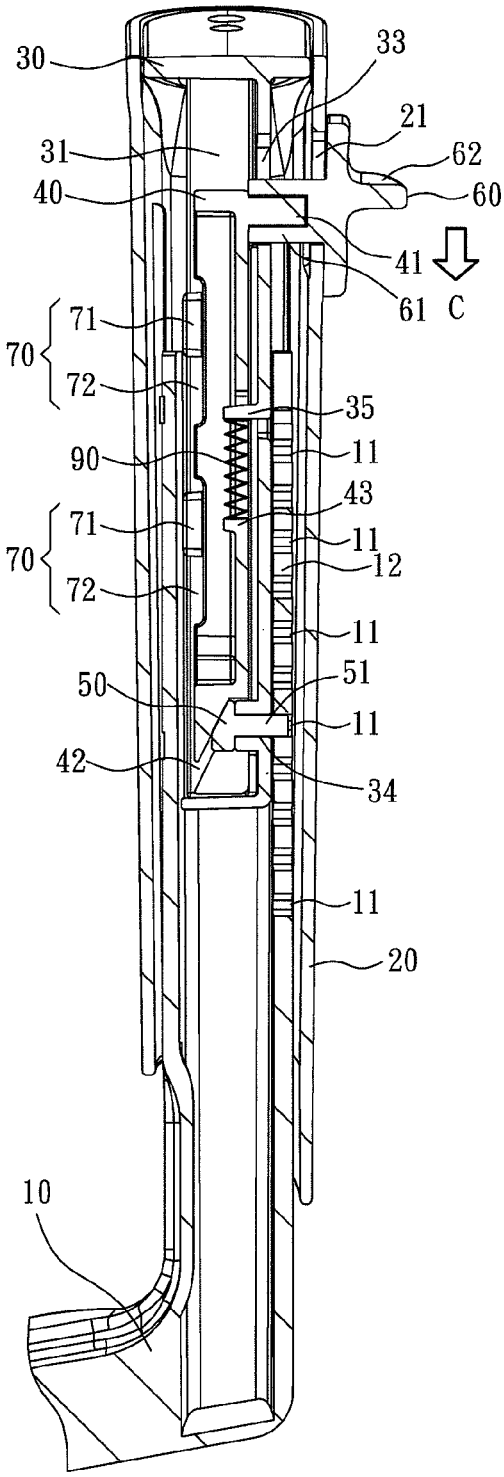
FIG. 11 is a cross sectional view of the embodiment in FIG. 1 for showing status after height adjustment.

Refer to FIG. 11, when the armrest is moved to a proper position, the pull handle 40 is released and driven to move downward by the elastic recovery force of the elastic member 90 so that the projecting blocks 71 of the alignment member 70 are moved along the slots 72 from the lower position to the higher position, as the arrow C indicates in FIG. 11. At the same time, the positioning member 50 is moved along the guiding slot 42 of the pull handle 40 from the lower position to the higher position and the locking part 51 of the positioning member 50 is moved outward (toward the right side in the figure) to be locked into another positioning hole 11. Therefore the height of the armrest has been adjusted.

In summary, the height adjustment mechanism for armrests of the present invention has a simple structure. Thus the number of molds used is reduced, the manufacturing cost is down, the assembly time is saved, and the convenience in assembly is improved. Moreover, such design is suitable for thin-wall structure. Compared with products produced by conventional techniques, the present invention has different structure, better function and higher competitiveness. The optimal design of the product is achieved.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalent.

What is claimed is:

1. A height adjustment mechanism for armrests comprising:

a tubular base whose lower part is connected to a chair seat while one side surface of an upper part thereof is disposed with a plurality positioning holes arranged vertically with a certain interval; the positioning holes are connected by a vertical long slot;

an outer sleeve that is disposed around an upper part of the tubular base and having an opening arranged at an upper end thereof and an armrest pad set at a top surface thereof;

a strip rack that is mounted in the outer sleeve and located inside the tubular base and having a groove formed along a length direction thereof, an opening on an upper part thereof and corresponding to the opening of the outer sleeve, and an insertion slot on a lower part thereof and corresponding to one of the positioning holes of the tubular base;

a pull handle that is mounted in the groove of the strip rack and having a projective rod that is disposed on a top end thereof and is corresponding to the opening of the strip rack and the opening of the outer sleeve;

a positioning member arranged at a lower end of the pull handle and being driven to be moved by the pull handle; one end of the positioning member is disposed with a locking part that is inserted through the insertion slot of the strip rack to be locked in one of the positioning holes of the tubular base;

a press member that is connected to the projective rod of the pull handle and is exposed outside the opening of the outer sleeve; while the press member being moved vertically, the pull handle is driven by the press member to move synchronously and vertically in relation to the strip rack; and an alignment member having at least a pair of projecting blocks and at least a pair of long slots corresponding to each other and respectively disposed on corresponding surfaces of the strip rack and the pull handle; the projecting block is able to move along the long slot so that displacement of the pull handle in relation to the strip rack is limited by the long slot;

wherein the locking part of the positioning member is released from one of the positioning holes of the tubular base and is moved vertically for adjusting height of armrests when the pull handle is moved upward;

wherein the locking part of the positioning member is released from one of the positioning holes of the tubular base and then is locked into another positioning hole of the tubular base when the pull handle is moved downward.

2. The adjustment mechanism as claimed in claim 1, wherein an outer side of an edge of the insertion slot is projecting to form the edge with a certain thickness.

3. The adjustment mechanism as claimed in claim 1, wherein a guiding slot is arranged at each of two opposite sides on a bottom end of the pull handle and is inclined and extended downward and outward; a left side and a right side of the other end of the positioning member project to form a guiding block respectively; each of the two guiding blocks is limited in and moved along the guiding slot of the pull handle so that a vertical movement of the pull handle is converted into a horizontal movement of the positioning member.

4. The adjustment mechanism as claimed in claim 1, wherein an inclined projection is formed on one end of the locking part of the positioning member and the inclined projection is moved along the long slot of the tubular base.

5. The adjustment mechanism as claimed in claim 1, wherein a projecting body with a concave hole is arranged at one end of the press member while an operation part is disposed on the other end thereof; the concave hole of the projecting body is disposed around the projective rod of the pull handle while the operation part is exposed outside the opening of the outer sleeve.

6. The adjustment mechanism as claimed in claim 5, wherein a left side and a right side of the projecting body respectively project to form a locking part; the locking parts is locked on a left edge and a right edge of the opening of the outer sleeve.

7. The adjustment mechanism as claimed in claim 1, wherein a left side and a right side of the strip rack project so as to form the pair of the projecting blocks while a left side and a right side of the pull handle are concaved to form the pair of the long slots.

8. The adjustment mechanism as claimed in claim 1, wherein the height adjustment mechanism for armrests further includes at least one C-shaped ring that is arranged around an upper part of the tubular base; two slots corresponding to two rear ends of the C-shaped ring are disposed on the upper part of the tubular base so that the two rear ends of the C-shaped ring are mounted and in the two slots respectively.

9. The adjustment mechanism as claimed in claim 1, wherein the height adjustment mechanism for armrests further includes an elastic member that is arranged between the strip rack and the pull handle; the strip rack is disposed with a stopper for leaning against one end of the elastic member while the pull handle is arranged with a stopper for leaning against the other end of the elastic member.

10. The adjustment mechanism as claimed in claim 1, wherein an outer side of an edge of the opening of the outer sleeve is projecting to form the edge with a certain thickness.

* * * * *